US009912040B2

(12) United States Patent
Irci et al.

(10) Patent No.: US 9,912,040 B2
(45) Date of Patent: Mar. 6, 2018

(54) ELECTRONIC DEVICE ANTENNA CARRIER COUPLED TO PRINTED CIRCUIT AND HOUSING STRUCTURES

(71) Applicant: Apple Inc., Cupertino, CA (US)

(72) Inventors: Erdinc Irci, Sunnyvale, CA (US); Hongfei Hu, Santa Clara, CA (US); Mattia Pascolini, San Francisco, CA (US); Yijun Zhou, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 413 days.

(21) Appl. No.: 14/262,486

(22) Filed: Apr. 25, 2014

(65) Prior Publication Data

US 2015/0311579 A1 Oct. 29, 2015

(51) Int. Cl.

| | |
|---|---|
| ***H01Q 1/24*** | (2006.01) |
| ***H01Q 9/42*** | (2006.01) |
| ***H01Q 13/10*** | (2006.01) |
| *H01Q 1/22* | (2006.01) |

(52) U.S. Cl.

CPC ..... *H01Q 1/243* (2013.01); *H01Q 9/42* (2013.01); *H01Q 13/10* (2013.01)

(58) Field of Classification Search

CPC ..... H01Q 1/241–1/243; H01Q 1/2258; H01Q 1/2266; H01Q 9/0421; H01Q 9/30; H05K 1/182

USPC ..... 343/702, 906, 700 MS, 878, 706; 361/760, 753, 799

See application file for complete search history.

(56) References Cited

U.S. PATENT DOCUMENTS

| | | | | |
|---|---|---|---|---|
| 4,672,386 A * | 6/1987 | Wood | H01Q 21/24 | 343/770 |
| 6,339,400 B1 * | 1/2002 | Flint | H01Q 1/22 | 343/702 |
| 6,448,932 B1 * | 9/2002 | Stoiljkovic | H01Q 1/243 | 343/700 MS |

(Continued)

OTHER PUBLICATIONS

"2.4 GHz Surface Mount Device (SMD) on-ground Antenna" Molex, [Retrieved on Jun. 18, 2014] Retrieved from the Internet: <http://www.molex.com/link/SMD_antenna.html>.

(Continued)

*Primary Examiner* — Hoang Nguyen
*Assistant Examiner* — Awat Salih
(74) *Attorney, Agent, or Firm* — Treyz Law Group, P.C.; G. Victor Treyz; Tianyi He

(57) ABSTRACT

Electronic device antenna structures may include first and second antennas. A housing may have a periphery that is surrounded by peripheral conductive structures such as a segmented peripheral metal member. A segment of the peripheral metal member may be separated from a ground by an opening. An antenna feed for the first antenna may have a positive antenna terminal coupled to the peripheral metal member and a ground terminal coupled to the ground. A return path for the first antenna may span the opening in parallel with the antenna feed. A plastic carrier may be mounted to a printed circuit and a metal housing structure using screws. The plastic carrier may support an antenna resonating element for the second antenna and may support the return path for the first antenna. The screws may short metal structures on the plastic carrier to the metal structures and traces on the printed circuit.

11 Claims, 11 Drawing Sheets

(56) References Cited

U.S. PATENT DOCUMENTS 6,486,834 B2 * 11/2002 Tsai ..... G06F 1/1616 343/702
7,271,769 B2 * 9/2007 Asano ..... G06F 1/1616 343/700 MS
7,463,196 B2 * 12/2008 Hilgers ..... H01Q 1/243 343/700 MS
7,589,681 B2 * 9/2009 Hung ..... H01Q 1/44 343/702
8,059,046 B2 11/2011 Nysen
8,130,170 B2 * 3/2012 Nakahata ..... H01Q 1/243 343/702
8,294,620 B2 * 10/2012 Flint ..... H01Q 1/22 343/702
8,305,274 B2 * 11/2012 Shim ..... H01Q 1/243 343/702
8,482,469 B2 7/2013 Ayala et al.
2002/0021250 A1 * 2/2002 Asano ..... H01Q 1/22 343/702
2004/0090371 A1 * 5/2004 Rossman ..... H01Q 1/243 343/700 MS
2004/0178960 A1 * 9/2004 Sun ..... H01Q 1/52 343/700 MS
2004/0257283 A1 * 12/2004 Asano ..... H01Q 1/243 343/702
2009/0051597 A1 * 2/2009 Wen ..... H01Q 1/243 343/700 MS
2009/0140934 A1 * 6/2009 Yamazaki ..... H01Q 1/38 343/702
2011/0128199 A1 * 6/2011 He ..... H01Q 1/38 343/742
2011/0181476 A1 * 7/2011 Raappana ..... H01Q 9/0442 343/702
2012/0027056 A1 * 2/2012 Shinkai ..... H01Q 3/44 375/219
2012/0299785 A1 11/2012 Bevelacqua
2013/0050046 A1 * 2/2013 Jarvis ..... H01Q 1/243 343/852
2013/0169490 A1 7/2013 Pascolini et al.
2013/0201067 A1 8/2013 Hu et al.
2013/0203364 A1 8/2013 Darnell et al.
2013/0257659 A1 10/2013 Darnell
2013/0307736 A1 11/2013 Larsen et al.
2013/0313328 A1 * 11/2013 Mohajer-Iravani ..... G06K 19/07749 235/492
2013/0321216 A1 12/2013 Jervis et al.
2014/0078017 A1 3/2014 Vanjani et al.
2014/0159989 A1 * 6/2014 Malek ..... H01Q 1/243 343/876

OTHER PUBLICATIONS

Bevelacqua et al., U.S. Appl. No. 13/860,396, filed Apr. 10, 2013.
Vazquez et al., U.S. Appl. No. 13/889,987, filed May 8, 2013.
Hu et al., U.S. Appl. No. 13/890,013, filed May 8, 2013.
Bevelacqua et al., U.S. Appl. No. 13/851,471, filed Mar. 27, 2013.
Jin et al., U.S. Appl. No. 13/846,471, filed Mar. 18, 2013.
Ouyang et al., U.S. Appl. No. 13/846,459, filed Mar. 18, 2013.
Zhou et al., U.S. Appl. No. 13/846,481, filed Mar. 18, 2013.

* cited by examiner

ELECTRONIC DEVICE ANTENNA CARRIER COUPLED TO PRINTED CIRCUIT AND HOUSING STRUCTURES

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may be provided that has antennas. The antennas may include a cellular telephone antenna, a wireless local area network antenna, and other antenna structures.

A housing may have a periphery that is surrounded by peripheral conductive structures such as a segmented peripheral metal member. A segment of the peripheral metal member may be separated from a ground by an opening. An antenna feed for a first antenna such as an inverted-F cellular telephone antenna may have a positive antenna terminal coupled to the peripheral metal member and a ground terminal coupled to the ground. A return path for the first antenna may span the opening in parallel with the antenna feed.

A plastic carrier may be mounted to a printed circuit and a metal housing structure using screws. The plastic carrier may support an antenna resonating element for a second antenna such as an inverted-F wireless local area network antenna and may support the return path for the first antenna. The screws may short metal structures on the plastic carrier to the metal structures and traces on the printed circuit, thereby serving both as antenna signal paths and mechanical fasteners.

DETAILED DESCRIPTION

Figure 1:
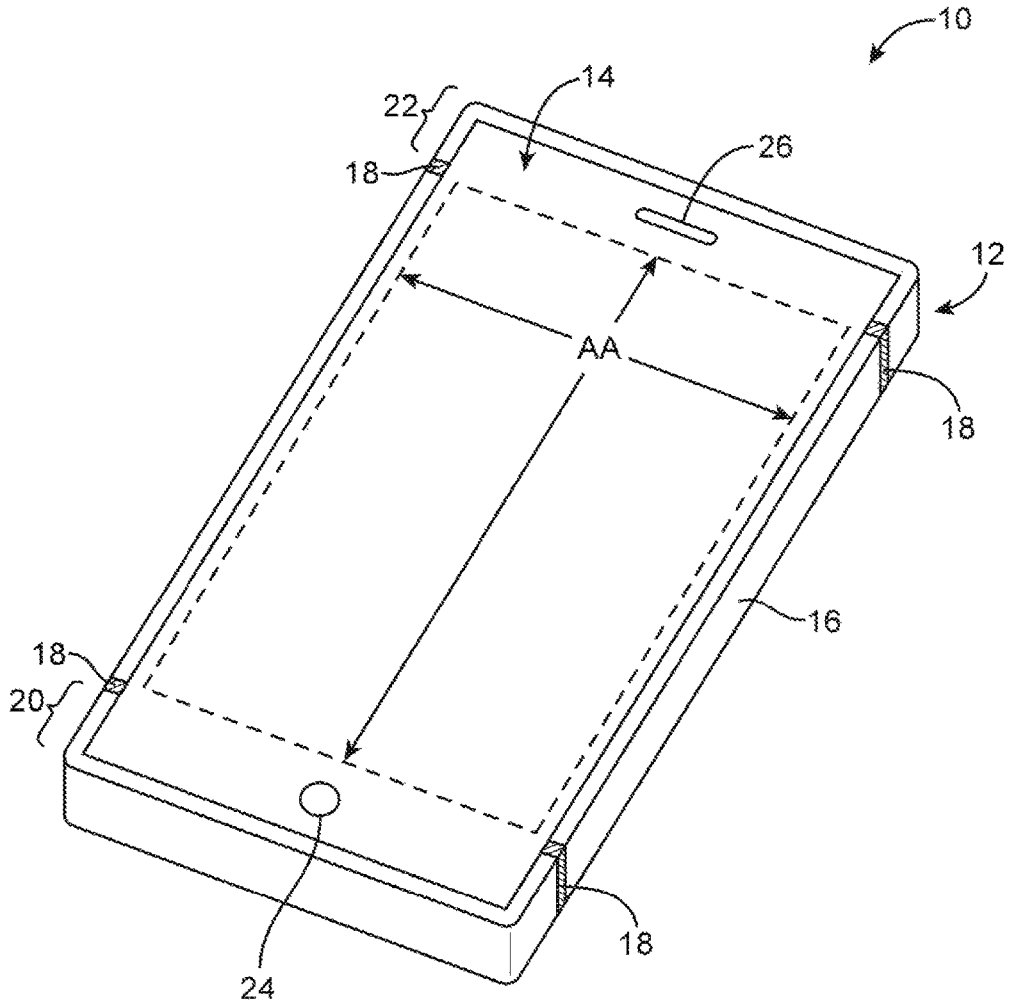
FIG. 1 is a perspective view of an illustrative electronic device with wireless circuitry in accordance with an embodiment.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures. The housing structures may include peripheral structures such as a peripheral conductive member that runs around the periphery of an electronic device. The peripheral conductive member may serve as a bezel for a planar structure such as a display, may serve as sidewall structures for a device housing, and/or may form other housing structures. Gaps may be formed in the peripheral conductive member that divide the peripheral conductive member into segments. One or more of the segments may be used in forming one or more antennas for electronic device 10.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a television, a set-top box, a desktop computer, a computer monitor into which a computer has been integrated, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using a peripheral housing member have a rectangular ring shape with four corresponding edges (as an example). Peripheral structures 16 or part of peripheral structures 16 may serve as a bezel for display 14 (e.g., a cosmetic trim that surrounds all four sides of display 14 and/or helps hold display 14 to device 10). Peripheral structures 16 may also, if desired, form sidewall structures for device 10 (e.g., by forming a metal band with vertical sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. If desired, the bottom portion of peripheral housing structures 16 may also have an enlarged lip (e.g., in the plane of the rear surface of device 10). In the example of FIG. 1, peripheral housing structures 16 have substantially straight vertical sidewalls. This is merely illustrative. The sidewalls formed by peripheral housing structures 16 may be curved or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the left and right sides of housing 12 may be formed as vertically extending integral metal portions of the planar metal structure. Housing structures such as these may, if desired, be machined from a block of metal.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 under active area AA of display 14 (e.g., the portion of display 14 that contains circuitry and other structures for displaying images).

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps or spaces, may be filled with air, plastic, and other dielectrics.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, extensions of the ground plane under active area AA of display 14 and/or other metal structures in device 10 may have portions that extend into parts of the dielectric-filled openings in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of such locations. The arrangement of FIG. 1 is merely illustrative.

Portions of peripheral housing structures 16 may be provided with gap structures. For example, peripheral housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

Figure 2:
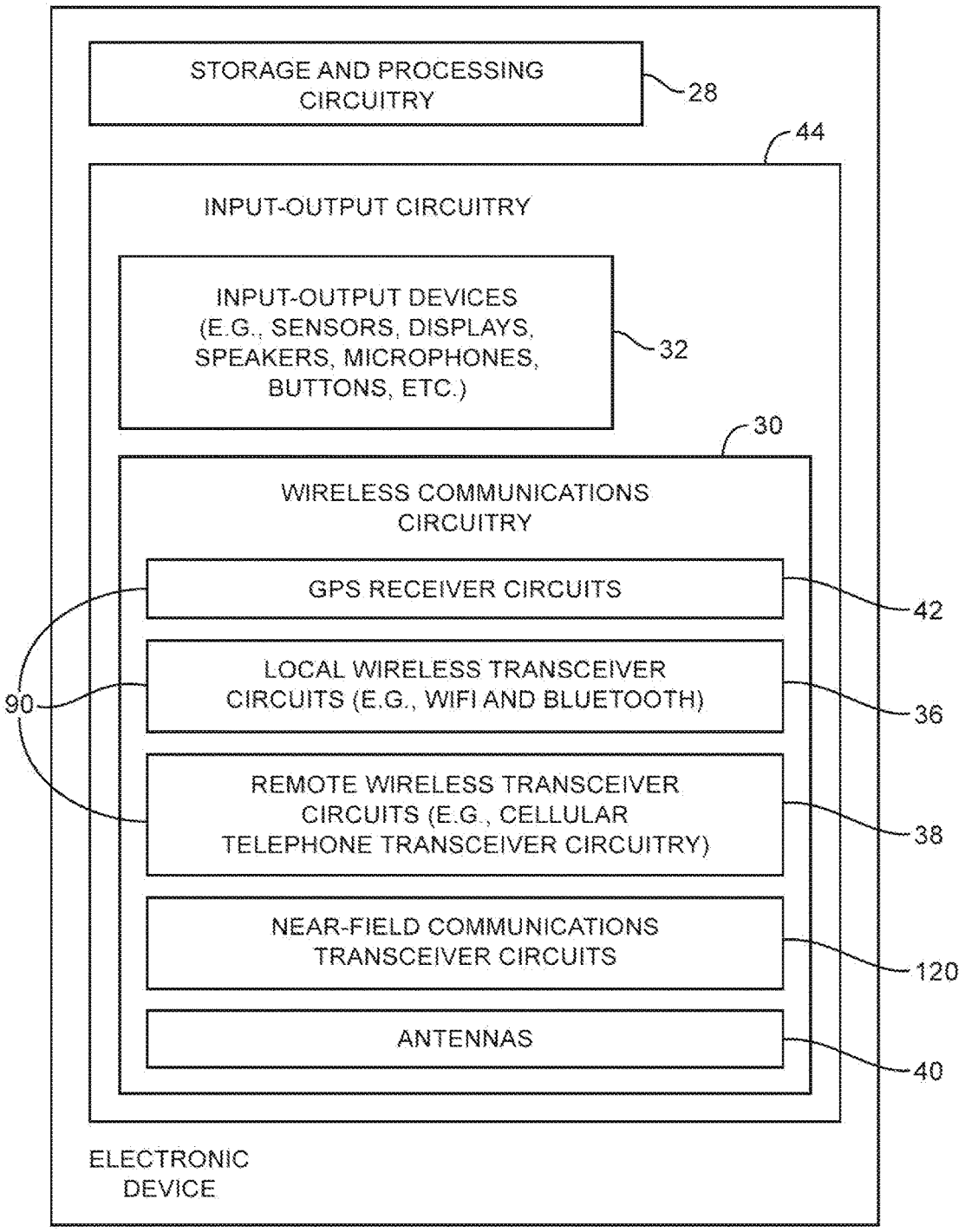
FIG. 2 is a schematic diagram of illustrative circuitry in an electronic device in accordance with an embodiment.

A schematic diagram showing illustrative components that may be used in device 10 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, near-field communications protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 may include satellite navigation system circuitry such as global positioning system (GPS) receiver circuitry 42 for receiving GPS signals at 1575 MHz or for handling other satellite positioning data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless circuitry 34 may include near-field communications circuitry 120. Near-field communications circuitry 120 may produce and receive near-field communications signals to support communications between device 10 and a near-field communications reader or other external near-field communications equipment. Near-field communications may be supported using loop antennas (e.g., to support inductive near-field communications in which a loop antenna in device 10 is electromagnetically near-field coupled to a corresponding loop antenna in a near-field communications reader). Near-field communications links typically are generally formed over distances of 20 cm or less (i.e., device 10 must be placed in the vicinity of the near-field communications reader for effective communications).

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna. In addition to supporting cellular telephone communications, wireless local area network communications, and other far-field wireless communications, the structures of antennas 40 may be used in supporting near-field communications. The structures of antennas 40 may also be used in gathering proximity sensor signals (e.g., capacitive proximity sensor signals).

Radio-frequency transceiver circuitry 90 does not handle near-field communications signals and is therefore sometimes referred to as far field communications circuitry or non-near-field communications circuitry. Near-field communications transceiver circuitry 120 is used in handling near-field communications. With one suitable arrangement, near-field communications can be supported using signals at a frequency of 13.56 MHz. Other near-field communications bands may be supported using the structures of antennas 40 if desired. Transceiver circuitry 90 may handle non-near-field communications frequencies (e.g., frequencies above 700 MHz or other suitable frequencies).

Figure 3:
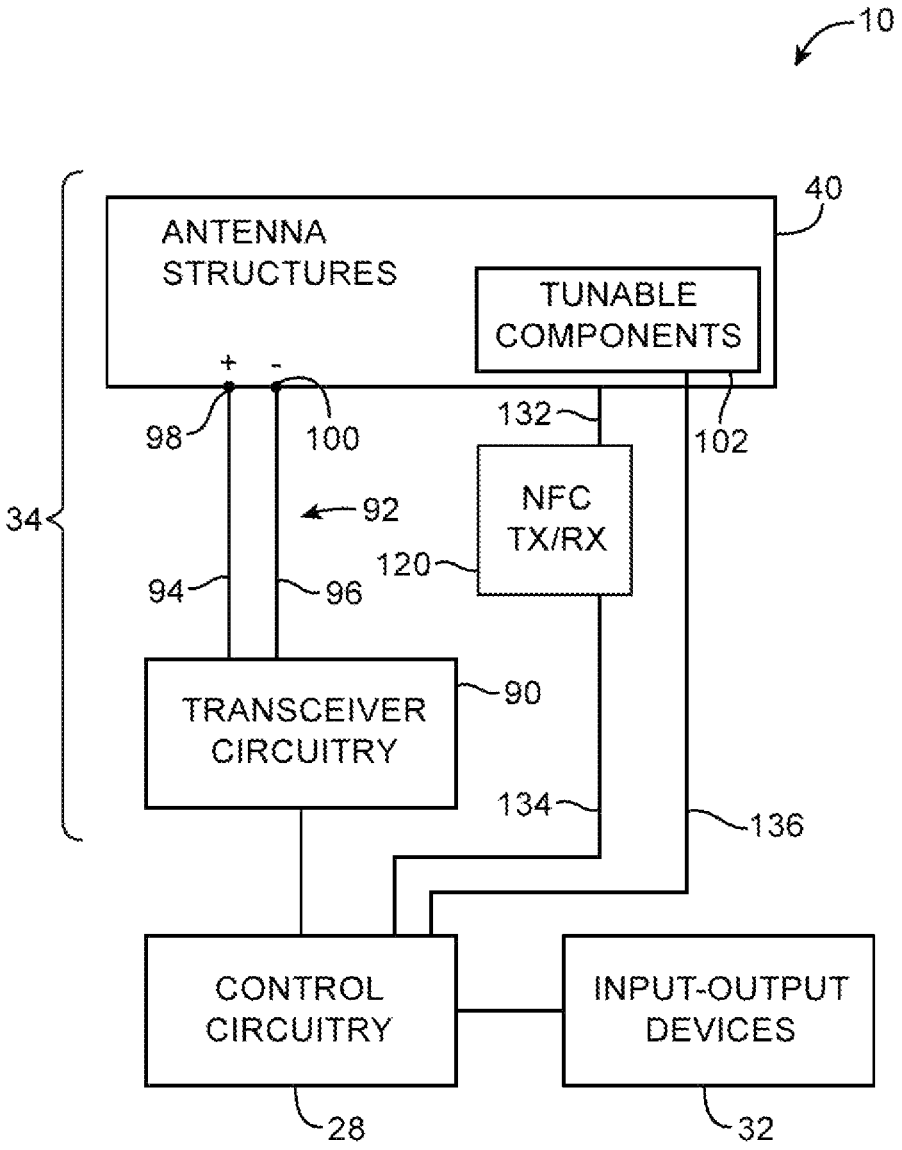
FIG. 3 is a schematic diagram of illustrative wireless circuitry in accordance with an embodiment.

As shown in FIG. 3, antenna structures 40 may be coupled to near-field communications circuitry such as near-field communications transceiver 120 and non-near-field communications circuitry such as non-near-field transceiver circuitry 90.

Non-near-field transceiver circuitry 90 in wireless circuitry 34 may be coupled to antenna structures 40 using paths such as path 92. Near-field communications transceiver circuitry 120 may be coupled to antenna structures 40 using paths such as path 132. Paths such as path 134 may be used to allow control circuitry 28 to transmit near-field communications data and to receive near-field communications data using a near-field communications antenna formed from structures 40.

Control circuitry 28 may be coupled to input-output devices 32. Input-output devices 32 may supply output from device 10 and may receive input from sources that are external to device 10.

To provide antenna structures 40 with the ability to cover communications frequencies of interest, antenna structures 40 may be provided with impedance matching circuitry, filters, and other antenna circuitry. This circuitry may include fixed and tunable circuits. Discrete components such as capacitors, inductors, and resistors may be incorporated into the antenna circuitry. Capacitive structures, inductive structures, and resistive structures may also be formed from patterned metal structures (e.g., part of an antenna). If desired, antenna structures 40 may be provided with adjustable circuits such as tunable components 102 to tune antennas over communications bands of interest. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. For example, tunable components 102 may include one or more adjustable capacitors (e.g., a programmable capacitor that can produce one of multiple different capacitance values by adjusting switching circuitry), one or more adjustable inductors (e.g., an adjustable inductor circuit having a multiplexer or other adjustable switching circuitry that allows a desired inductor value to be selected from multiple different available inductor values), or other adjustable components.

During operation of device 10, control circuitry 28 may issue control signals on one or more paths such as path 136 that adjust inductance values, capacitance values, or other parameters associated with tunable components 102, thereby tuning antenna structures 40 to cover desired communications bands. Active and/or passive components may also be used to allow antenna structures 40 to be shared between non-near-field-communications transceiver circuitry 90 and near-field communications transceiver circuitry 120. Near-field communications and non-near-field communications may also be handled using two or more separate antennas, if desired.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry and other antenna circuitry in antenna structures 40.

Transmission line 92 may be directly coupled to an antenna resonating element and ground for antenna 40 or may be coupled to indirect-feed antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. As another example, antenna structures 40 may include an antenna resonating element such as a slot antenna resonating element or other element that is indirectly fed. In indirect feeding arrangements, transmission line 92 is coupled to an antenna feed structure that is used to indirectly feed antenna structures such as an antenna slot or other element through electromagnetic near-field coupling.

Antennas 40 may include slot antenna structures, inverted-F antenna structures (e.g., planar and non-planar inverted-F antenna structures), loop antenna structures, or other antenna structures.

Figure 4:
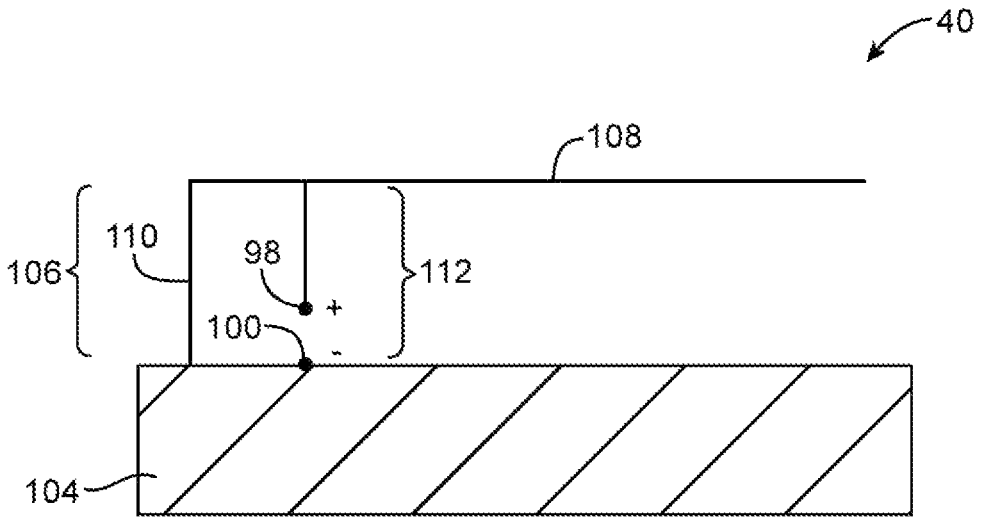
FIG. 4 is a schematic diagram of an illustrative inverted-F antenna in accordance with an embodiment.

An illustrative inverted-F antenna structure is shown in FIG. 4. Inverted-F antenna structure 40 of FIG. 4 has antenna resonating element 106 and antenna ground (ground plane) 104. Antenna resonating element 106 may have a main resonating element arm such as arm 108. The length of arm 108 may be selected so that antenna structure 140 resonates at desired operating frequencies. For example, the length of arm 108 (or a branch of arm 108) may be a quarter of a wavelength at a desired operating frequency for antenna 40. Antenna structure 140 may also exhibit resonances at harmonic frequencies. If desired, slot antenna structures or other antenna structures may be incorporated into an inverted-F antenna such as antenna 40 of FIG. 4 (e.g., to enhance antenna response in one or more communications bands).

Main resonating element arm 108 may be coupled to ground 104 by return path 110. Antenna feed 112 may include positive antenna feed terminal 98 and ground antenna feed terminal 100 and may run parallel to return path 110 between arm 108 and ground 104. If desired, inverted-F antenna structures such as illustrative antenna structure 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). If desired, antennas such as inverted-F antenna 40 of FIG. 4 may have tunable components such as components 102 of FIG. 3.

Figure 5:
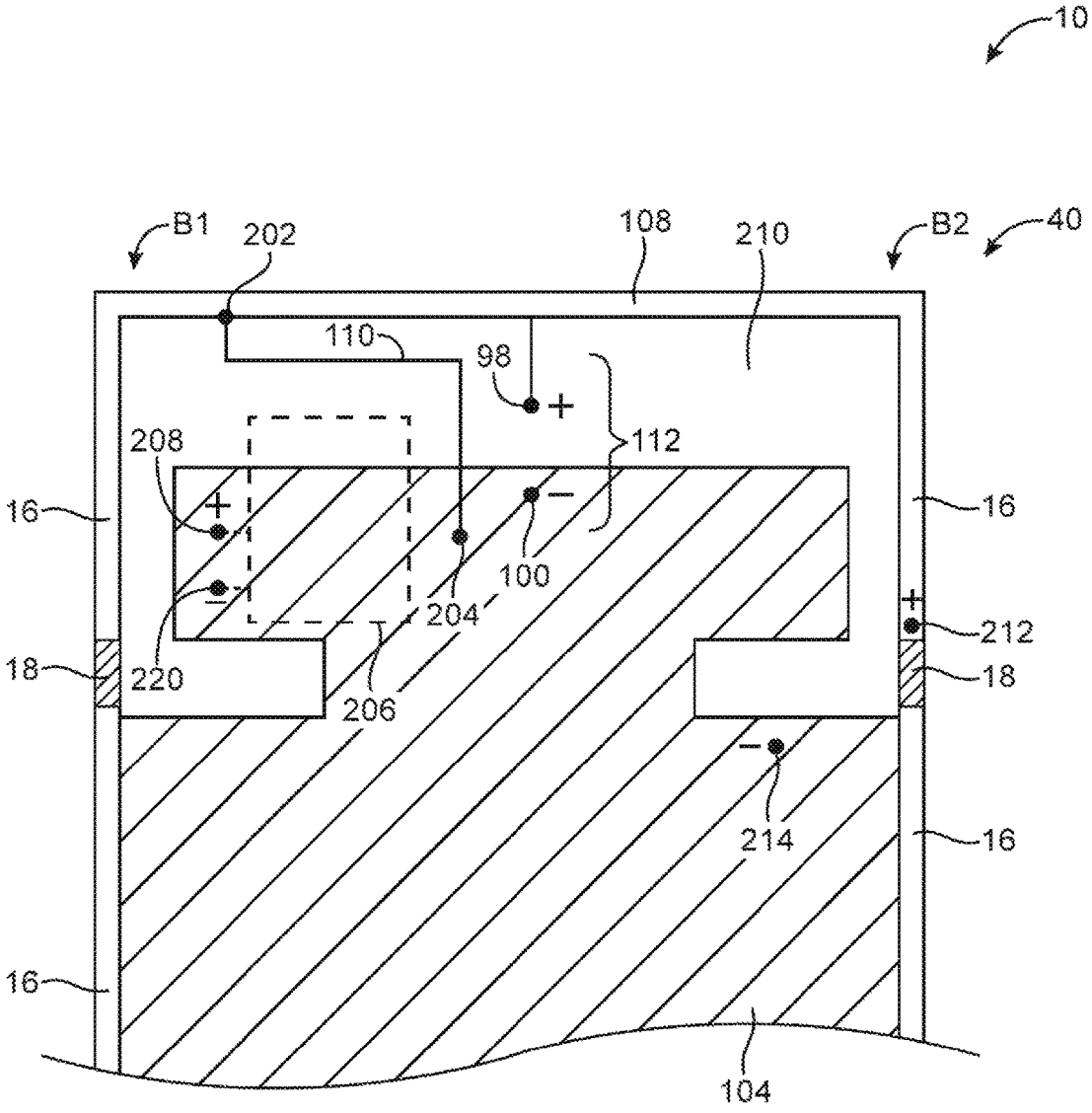
FIG. 5 is a top view of illustrative antenna structures in an electronic device in accordance with an embodiment.

A top interior view of an illustrative portion of device 10 that contains antennas is shown in FIG. 5. As shown in FIG. 5, device 10 may have peripheral conductive housing structures such as peripheral conductive housing structures 16. Peripheral conductive housing structures 16 may be segmented by dielectric-filled gaps (e.g., plastic gaps) such as gaps 18. An inverted-F antenna may be formed from a resonating element and ground 104. The resonating element may include an inverted-F antenna resonating element arm such as arm 108 that is formed from a length of peripheral conductive housing structures 16 between gaps 18. Air and/or other dielectric may fill opening 210 between arm 108 and ground structures 104. If desired, opening 210 may be configured to form a slot antenna resonating element structure that contributes to the overall performance of the inverted-F antenna. Ground 104 may be formed from a metal midplate member or other internal housing structures, metal housing structures such as portions of peripheral conductive structures 16 that are adjacent to a midplate, or other conductive structures.

Ground 104 may serve as antenna ground for one or more antennas. For example, an inverted-F antenna may be formed from arm 108 and ground 104, whereas a wireless local area network antenna may be formed from a resonating element in region 206 and ground 104. The inverted-F antenna may have an antenna feed such as feed 112 with terminals 98 and 100. Positive antenna feed terminal 98 may be coupled to arm 108. Ground antenna feed terminal 100 may be coupled to ground 104. The inverted-F antenna may also have a return path such as return path 110 coupled between arm 108 (at node 202) and ground 104 (at node 204). Return path 110 may run parallel to feed 112. The wireless local area network antenna in region 206 may contain an inverted-F antenna resonating element or other suitable resonating element. The wireless local area network antenna may be fed using an antenna feed having positive antenna feed terminal 208 and ground antenna feed terminal 220. The ground antenna feed terminal may be coupled to ground 104 (i.e., ground 104 may serve as ground for the wireless local area network antenna).

If desired, a near-field communications transceiver and balun circuit may be used to apply near-field communications signals to near-field communications antenna feed terminal 212. The ground output of the balun may be coupled to ground terminal 214 on ground 104. During near-field communications, loop currents may flow through part of arm 108, return path 110 or other suitable path across gap 210, and ground 104.

Figure 6:
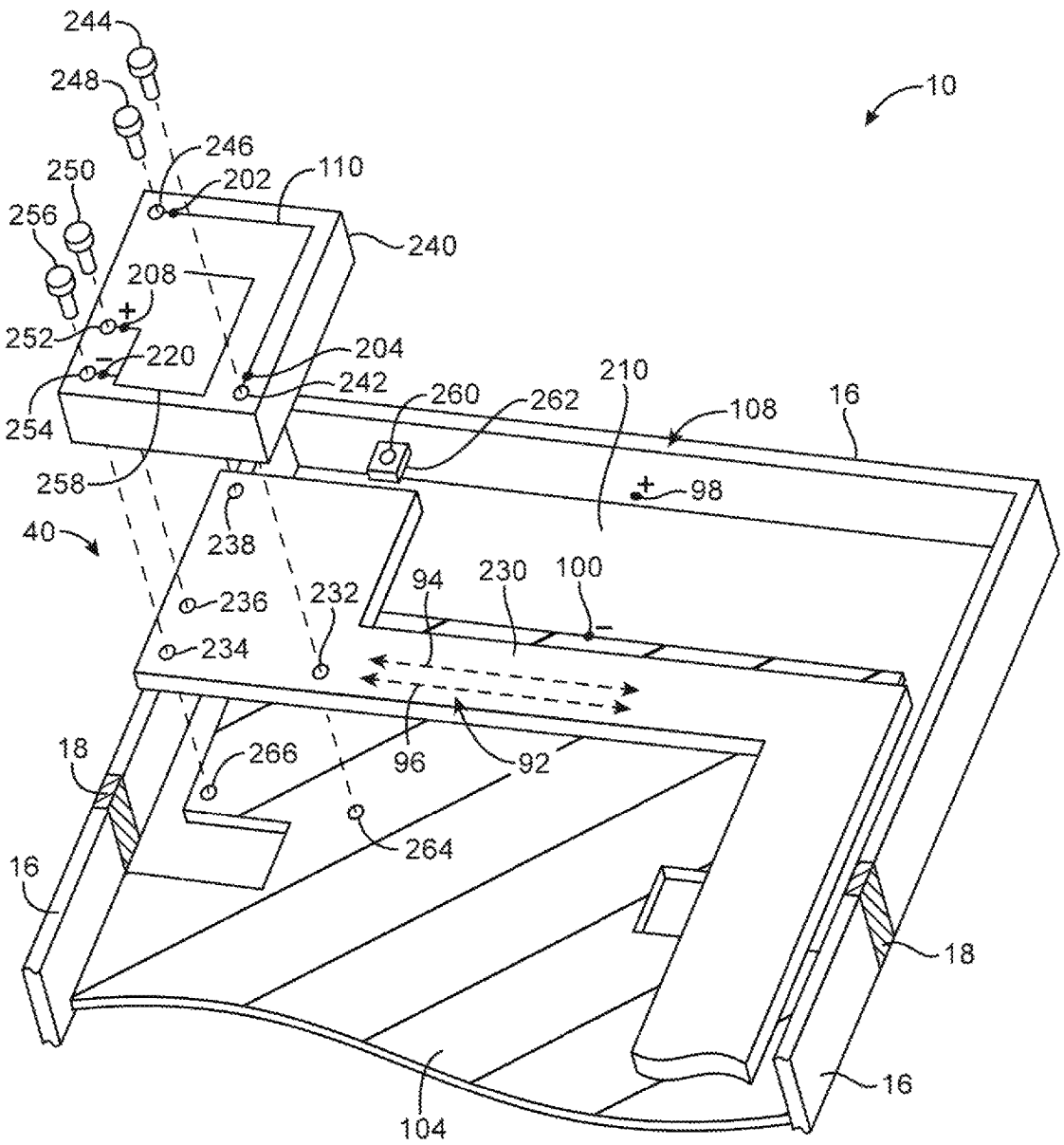
FIG. 6 is a perspective view of an end of an electronic device having housing structures, printed circuit structures, and antenna carrier structures in accordance with an embodiment.

FIG. 6 is an exploded perspective view of the interior portion of electronic device 10 shown in FIG. 5. As shown in FIG. 6, device 10 may include a metal housing plate or other internal conductive structures for forming ground 104 (e.g., internal metal housing structures, etc.). Opening 210 may separate arm 108 of the inverted-F antenna from ground 104. Antenna feed 112 may be formed from terminals coupled to opposing sides of opening 210 such as positive antenna feed terminal 98 and ground antenna feed terminal 110. Return path 110 and other antenna structures may be formed from metal traces on a dielectric support structure such as plastic carrier 240. When installed in device 10, return path 110 may have a first end coupled to arm 108 and a second end coupled to ground 104.

Printed circuit 230 may have one or more layers and may include metal traces patterned to form transmission line path 92 (see, e.g., transmission line signal lines 94 and 96). If desired, separate transmission line paths may be formed (e.g., using flexible printed circuit cables, coaxial cables, etc.). Printed circuit 230 may be a rigid printed circuit board (e.g., a printed circuit board formed from fiberglass-filled epoxy or other rigid printed circuit board material) or may be a flexible printed circuit (e.g., a flexible printed circuit formed from a sheet of polyimide or other flexible polymer layer).

Metal traces on plastic carrier 240 may form an inverted-F antenna resonating element such as inverted-F antenna resonating element 258. The inverted-F antenna may be coupled to positive and ground antenna feed terminals such as terminals 208 and 254. The antenna formed from inverted-F antenna resonating element arm 108 and ground 104 may be a cellular telephone antenna or other suitable antenna and the antenna formed from inverted-F antenna resonating element 258 may be a wireless local area network antenna or other suitable antenna (as examples).

Screws such as screws 256, 250, 248, and 244 may be used mount carrier 240 and printed circuit 230 within the housing of device 10 and may be used to carry antenna signals.

Screw 256 may form an electrical contact between terminal 220 of resonating element 258 and ground 104. Screw 256 may pass through opening 254 in carrier 240 and opening 234 in printed circuit 230 and may screw into threaded opening 266 in ground 104.

Screw 250 may be used to form an electrical contact between terminal 208 of resonating element 258 and positive signal trace 94. Screw 250 may pass through opening 252 of carrier 240 and opening 236 in printed circuit 230. Screw 250 may screw into a threaded screw boss or other structure in device 10.

Screw 248 may be used to couple node 202 on return path trace 110 on carrier 240 to arm 108 via protrusion 262. Protrusion 262 may be a metal structure having a threaded opening such as opening 260 that receives the shaft of screw 248. Carrier 240 may have an opening such as opening 246 to accommodate screw 248. Printed circuit board 230 may have a mating opening such as opening 238. When screw 248 passes through openings 246 and 238 and is screwed into opening 260, node 202 of return path trace 110 on carrier 240 is shorted to the portion of peripheral conductive housing structure 16 that forms arm 108 though protrusion 262.

Screw 244 may be used to electrically short node 204 of return path trace 110 on carrier 240 to ground 104. Screw 244 may pass through opening 242 in carrier 240, may pass through opening 232 in printed circuit 230, and may screw into opening 264 in ground 104.

In the example of FIG. 6, plastic carrier 240 is used to support both an inverted-F antenna resonating element such as inverted-F antenna resonating element 258 for a first inverted-F antenna (e.g., a wireless local area network antenna) and metal traces such as return path 110 for forming part of a second inverted-F antenna (e.g., a cellular telephone inverted-F antenna). If desired, plastic carrier 240 may carry antenna traces for a single antenna, may carry antenna traces for two different antennas, may carry antenna traces for two or more different antennas, may carry antenna traces for three or more different antennas, etc.

Figure 7:
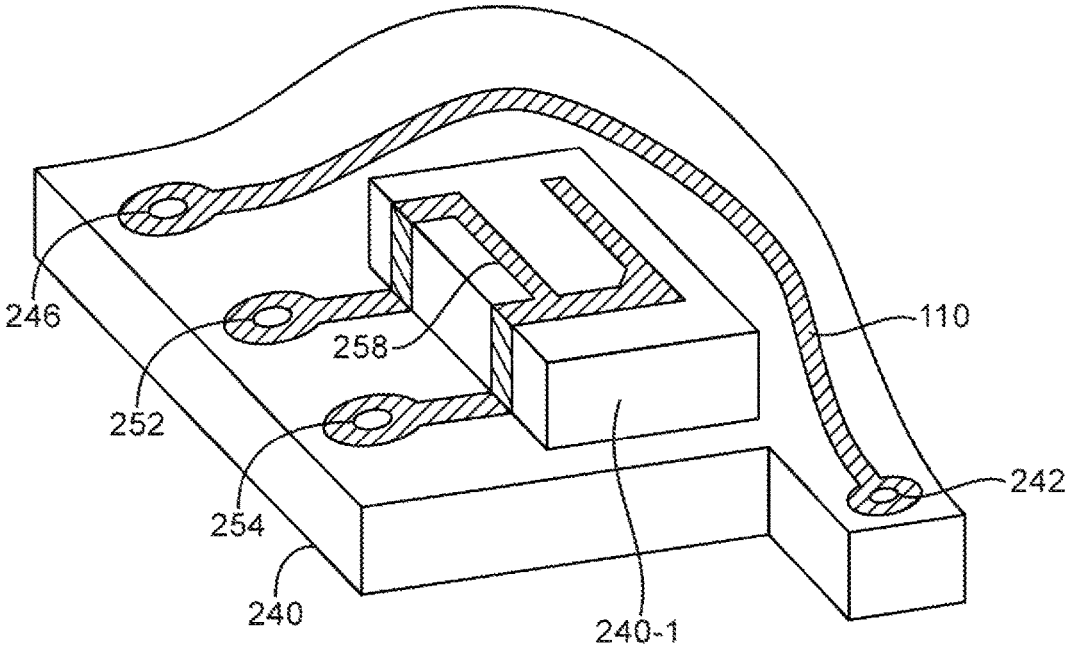
FIG. 7 is a perspective view of an illustrative carrier on which antenna structures have been formed in accordance with an embodiment.

Carrier 240 may be formed from molded plastic or other dielectric. An illustrative configuration for carrier 240 is shown in FIG. 7. As shown in FIG. 7, carrier 240 may be used to support metal antenna traces forming inverted-F antenna resonating element 258. Carrier 240 may also be used to support metal antenna traces for forming return path 110 in a cellular telephone inverted-F antenna or other antenna structures. Portion 240-1 of structure 240 may form a dielectric block that serves as a riser for resonating element 258. The block raises antenna resonating element 258 upwards away from underlying conductive structures such as ground 104, thereby enhancing antenna bandwidth. The metal traces on carrier 240 such as the metal traces that form antenna resonating element 258 and the metal traces that form return path 110 may be formed from laser patterned metal (e.g., metal plated onto carrier 240 following selective laser activation of desired antenna trace areas by laser exposure using laser direct structuring techniques), may be formed from metal foil that has been incorporated into carrier 240 using insert molding techniques, and can include internal and/or external metal antenna structures.

Figure 8:
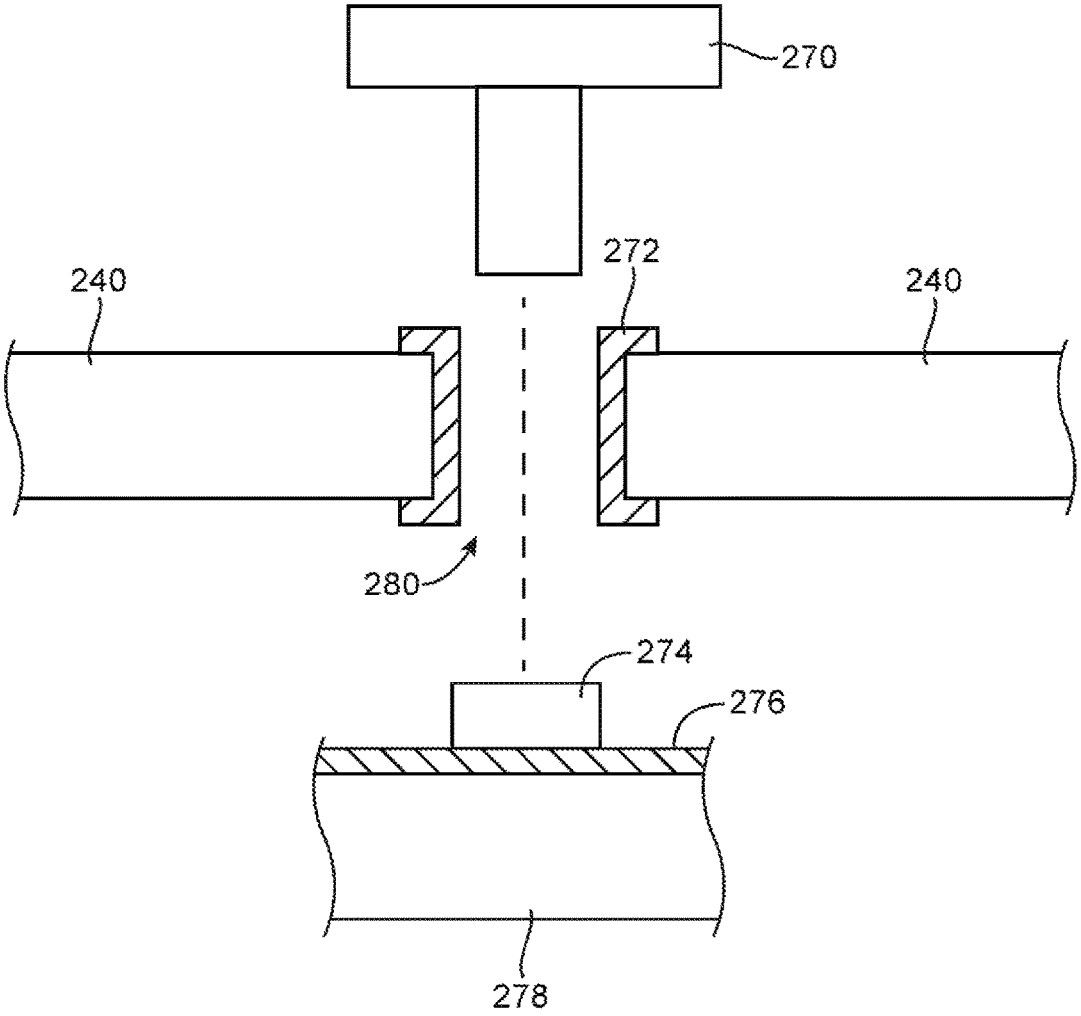
FIG. 8 is a cross-sectional side view of illustrative antenna carrier structures being mated to corresponding printed circuit board structures in accordance with an embodiment.

FIG. 8 is a cross-sectional side view of illustrative structures that may be used in coupling metal structures on carrier 240 to other portions of device 10. As shown in FIG. 8, metal structures 272 may be formed on carrier 240. Structures 272 may include surface metal traces and/or embedded metal foil or other metal structures that form antenna structures (e.g., resonating element 258 and/or carrier 110, etc.). Some of metal structures 272 may, if desired, be used to coat the interior of carrier openings such as illustrative carrier opening 280. Portions of metal structures 272 may be formed on the upper surface of carrier 240 and/or on the lower surface of carrier 240. The metal structures on carrier 240 can be coupled to a printed circuit board, metal housing structure, or other structure in device 10 using a threaded structure such as illustrative threaded structure 274 (e.g., part of a housing, part of a metal boss that has been soldered to a printed circuit, printed circuit 230, ground 104, etc.). Screw structure 274 may be shorted to metal trace 276 on a substrate such as support structure 278 (e.g., part of ground 104, part of printed circuit 230, or part of other device structures). When screw 270 is screwed into a threaded structure such as a threaded opening in ground 104, a threaded screw boss, or other threaded structure 274, metal 272 will contact structure 274 and will be shorted to structure 274 (in embodiments where metal 272 coats the lower surface of structure 240 and in which structure 274 is conductive). Structure 274 may be electrically shorted to trace 276, so attachment of screw 270 to structure 274 will short screw 270 and metal structures 272 on carrier 240 to structure 274 and metal lines 276 on substrate 278.

Figure 9:
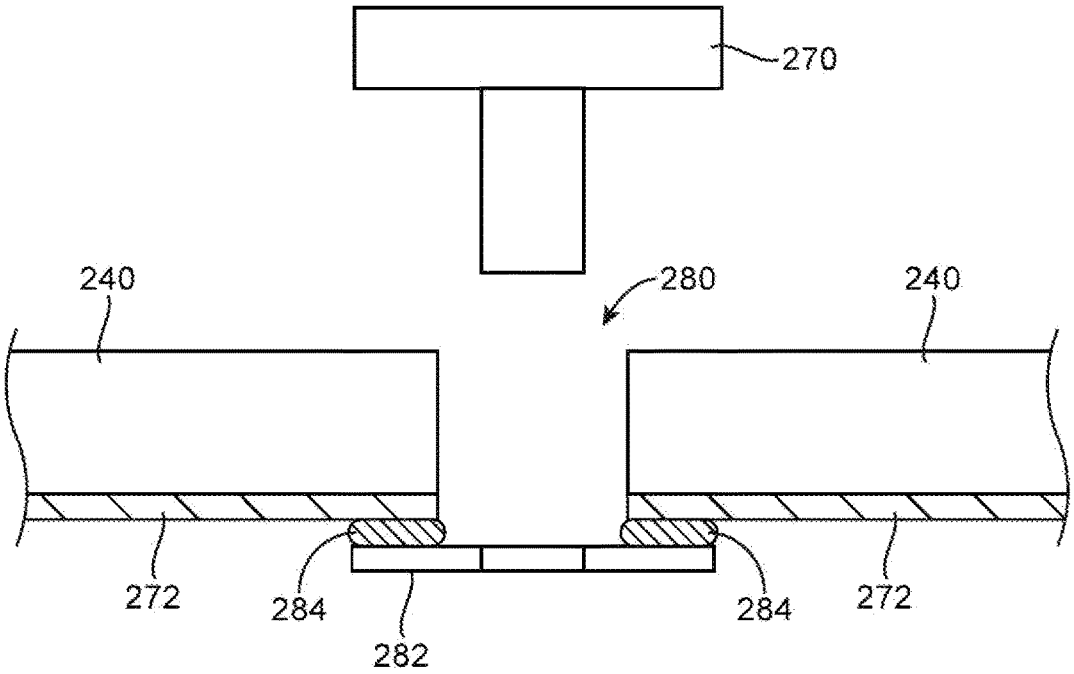
FIG. 9 is a cross-sectional side view of illustrative washer structures that may be used to help form an antenna connection and protect metal traces on an antenna carrier in accordance with an embodiment.

FIG. 9 shows how washer 282 may be used to protect metal traces 272 on the lower surface of carrier 240 from excessive crushing force when screwing screw 270 to other structures in device 10. Washer 282 may have a ring shape with a circular central opening. Solder 284 may be used to attach washer 282 to the lower surface of carrier 240. Washer 282 may be formed from metal to help short screw 270 and antenna traces 272 on carrier 240 to underlying structures (e.g., a screw boss, a threaded opening in ground 104 or other housing structure, etc.).

Figure 10:
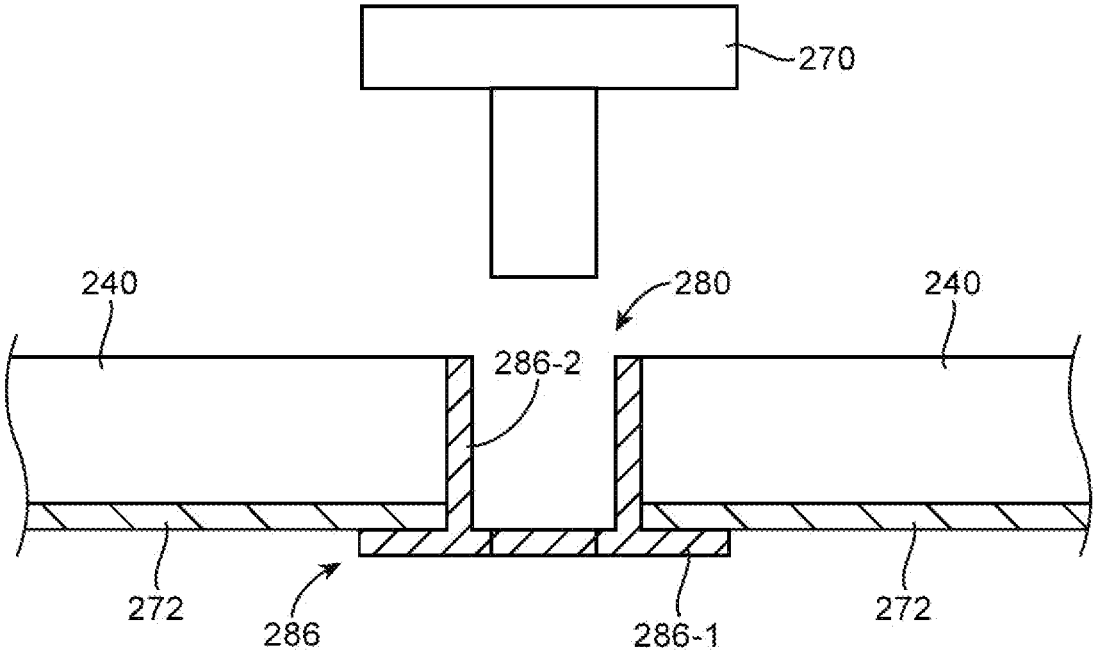
FIG. 10 is a cross-sectional side view of illustrative sleeve structures that may be used to help form an antenna connection and protect metal traces on an antenna carrier in accordance with an embodiment.

In the illustrative configuration of FIG. 10, protective sleeve 286 has been inserted into opening 280. Sleeve 286 has a flat washer-shaped lower portion 286-1 and a hollow cylindrical portion 286-2. Lower portion 286 serves to protect traces 272 on the lower surface of carrier 240 from excessive force when screw 270 is screwed into structures in device 10. Portion 286-2 helps hold sleeve 286 in place. Sleeve 286 may be formed from metal and may help short traces on carrier 240 such as illustrative antenna trace 272 to underlying structures in device 10. Solder may be used in attaching sleeve 286 to carrier 240 or portion 286-2 of sleeve 286 may be press fit into opening 280 to secure sleeve 286.

If desired, other techniques may be used for strengthening the plastic material of support 240 and/or protecting metal traces on support 240 and in assisting the formation of shorting paths between screws such as screw 270, trace 272, and other conductive structures in device 10. The examples of FIGS. 9 and 10 are merely illustrative.

Figure 11:
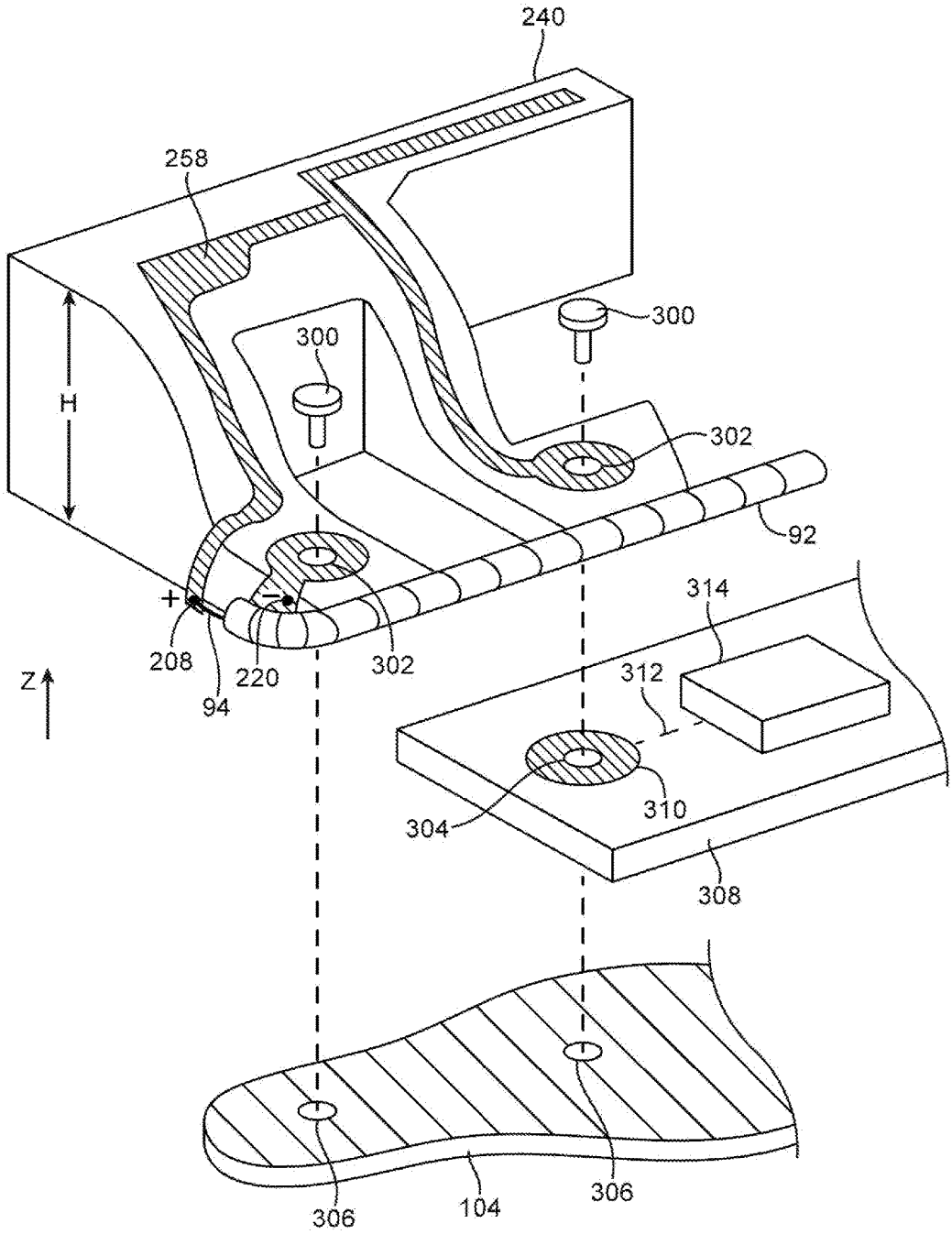
FIG. 11 is a perspective view of illustrative antenna structures supported by a dielectric carrier that is mounted to housing and printed circuit structures in accordance with an embodiment.

FIG. 11 is a perspective view of another illustrative carrier configuration that may be used for supporting antenna structures for antennas 40. As shown in FIG. 11, antenna resonating element 258 may have a positive feed terminal such as feed terminal 208 that is coupled to positive signal line 94 (i.e., a center conductor in coaxial cable transmission line 92). An outer braid conductor in cable 92 may be shorted to antenna ground terminal 220. Screws 300 may be used to couple resonating element antenna structure 258 to housing 104 and additional structures such as flexible printed circuit 308. Flexible printed circuit 308 may contain electrical components such as illustrative component 314 (e.g., tuning components 102 of FIG. 3, filter components, matching circuit components, and/or non-antenna components). Traces such as trace 312 and trace 310 may form electrical contacts for mating with screws 300 and/or metal traces on carrier 240 (e.g., metal traces shorted to resonating element 258 using arrangements of the type shown in FIGS. 9 and 10 or other arrangements). Carrier 240 may be mounted to ground 104 (e.g., an internal portion of the housing of device 10 or other structures in device 10) by screwing screws 300 into holes 306 through openings such as holes 320 in carrier 240 and hole 304 in flexible printed circuit 308. The height H of carrier 240 in dimension Z may help raise resonating element 258 above ground 104 to enhance antenna bandwidth (i.e., carrier 240 may serve as a riser to elevate antenna resonating element 258 to a desired vertical position above ground 104).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing;

a printed circuit in the housing;

a plastic antenna carrier;

an antenna resonating element on the plastic antenna carrier;

transceiver circuitry;

at least one conductive fastener that carries antenna signals from the transceiver circuitry to the antenna resonating element and that mounts the plastic antenna carrier against the printed circuit;

a conductive trace on the plastic antenna carrier; and a ground plane, wherein the at least one conductive fastener comprises:

a first screw that mounts the plastic antenna carrier to the printed circuit and the ground plane and that shorts the antenna resonating element to the ground plane;

a second screw that mounts the plastic antenna carrier to the printed circuit and the ground plane and that shorts the conductive trace to the ground plane; and a third screw that mounts the plastic antenna carrier to the printed circuit and that is shorted to a conductive trace on the printed circuit.

2. The electronic device defined in claim 1 wherein the conductive fastener mounts the plastic antenna carrier to the housing and shorts the antenna resonating element to the housing.

3. The electronic device defined in claim 2 wherein the housing forms at least part of an antenna ground and the antenna resonating element and the antenna ground form an inverted-F antenna.

4. The electronic device defined in claim 2 wherein the housing forms at least part of an antenna ground, the antenna resonating element and the antenna ground form a first inverted-F antenna, the electronic device further comprises a second inverted-F antenna, and the second inverted-F antenna has an antenna resonating element formed from a peripheral conductive housing structure in the housing.

5. The electronic device defined in claim 1 wherein the antenna resonating element forms part of a first antenna, the electronic device further comprises a second antenna, a first portion of the second antenna is supported by the plastic antenna carrier, and a second portion of the second antenna is not supported by the plastic antenna carrier.

6. The electronic device defined in claim 5 wherein the second antenna comprises an inverted-F antenna having a resonating element arm and a return path coupled between an antenna ground and the resonating element arm and the portion of the second antenna that is supported by the plastic antenna carrier includes the return path.

7. The electronic device defined in claim 1 wherein the printed circuit includes metal traces shorted to the conductive fastener.

8. The electronic device defined in claim 1 wherein the housing comprises metal and the conductive fastener is shorted to the metal.

9. The electronic device defined in claim 1 wherein the antenna resonating element comprises a wireless local area network inverted-F antenna resonating element.

10. The electronic device defined in claim 9 further comprising an inverted-F antenna return path trace on the plastic antenna carrier that is not shorted to the antenna resonating element.

11. An electronic device, comprising:

a housing;

a printed circuit in the housing;

a plastic antenna carrier;

an antenna resonating element on the plastic antenna carrier;

at least one conductive fastener that carries antenna signals and that mounts the plastic antenna carrier against the printed circuit; and a ground plane, wherein the at least one conductive fastener comprises first and second screws, the first screw passes through the plastic antenna carrier and the printed circuit and shorts a portion of the antenna resonating element to the ground plane, and the second screw passes through the plastic antenna carrier, does not pass through the printed circuit, and is shorted to the ground plane.

* * * * *